United States Patent [19]

Emeterio et al.

[11] Patent Number: 4,537,560

[45] Date of Patent: Aug. 27, 1985

[54] RADIAL KEY FOR STEAM TURBINE WHEELS

[75] Inventors: Eloy V. Emeterio, Amsterdam; Robert E. Deallenbach, Schenectady; Martin F. O'Connor, Scotia; Oleg Klufas, Schenectady, all of N.Y.

[73] Assignee: General Electric Company, Schenectady, N.Y.

[21] Appl. No.: 614,902

[22] Filed: May 29, 1984

[51] Int. Cl.[3] ..... F01D 5/06

[52] U.S. Cl. ..... 416/198 A; 415/199.5; 416/244 A

[58] Field of Search ..... 416/198 A, 201 R, 199, 416/200 A, 244 A; 415/199.5

[56] References Cited

U.S. PATENT DOCUMENTS

| | | | |
|---|---|---|---|
| 1,107,238 | 8/1914 | Kieser | 416/198 A |
| 1,792,288 | 2/1931 | Dempster | 415/199.5 X |
| 1,873,956 | 8/1932 | Dahlstrand | 416/198 A X |
| 2,660,399 | 11/1953 | Robinson et al. | 416/198 A |
| 3,680,979 | 8/1972 | Hansen et al. | 416/198 A |
| 4,029,437 | 6/1977 | Aubry et al. | 416/198 A |
| 4,330,236 | 5/1982 | LeBreton | 416/244 A X |
| 4,477,227 | 10/1984 | Klufas | 416/244 A X |
| 4,497,612 | 2/1985 | Knorowski et al. | 416/201 R X |

FOREIGN PATENT DOCUMENTS

| | | | |
|---|---|---|---|
| 513004 | 6/1932 | Fed. Rep. of Germany | 416/198 |

*Primary Examiner*—Everette A. Powell, Jr.

*Attorney, Agent, or Firm*—John F. Ahern; Paul Checkovich

[57] ABSTRACT

In a steam turbine, apparatus for preventing rotation of a first wheel with respect to a second wheel adjacent the first wheel, wherein the first and second wheels are secured to a shaft of a rotor of the steam turbine by an interference shrink fit, comprises a key disposed in a keyway defined by and between respective hubs of the wheels. The key is exposed to ambient environment of the rotor and is spaced from the axial ends of the keyway to permit steam to flow through portions of the keyway. Key and keyway configurations for prohibiting radial movement of the key are illustrated.

18 Claims, 13 Drawing Figures

FIG. 6a
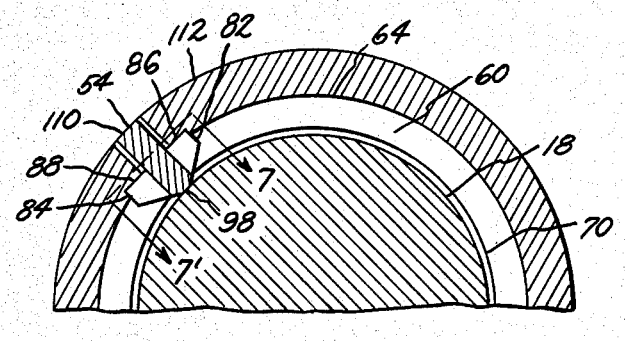
FIG. 6b
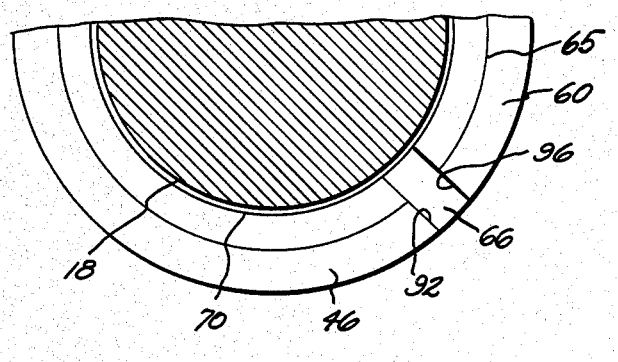
FIG. 12
FIG. 7
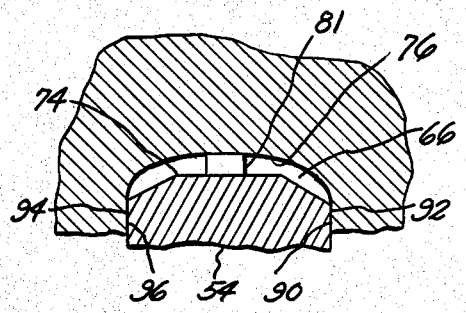
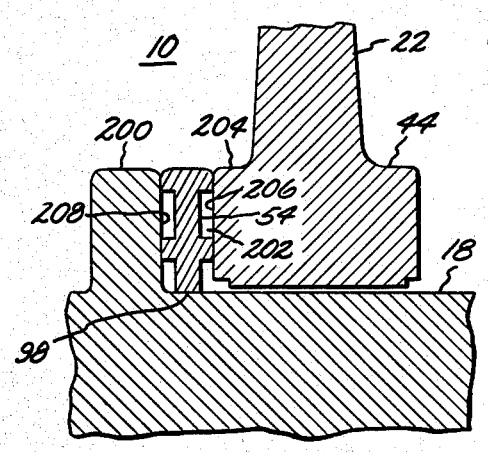

RADIAL KEY FOR STEAM TURBINE WHEELS

BACKGROUND OF THE INVENTION

This invention relates generally to keying means for preventing rotation of one steam turbine wheel relative to an adjacent wheel, both wheels being carried by a shaft, in the event a shrink fit between the one wheel and the shaft loosens.

Some steam turbines utilize such large rotors that the turbine wheels, which carry the turbine blades at their radially outermost portions, are not an integral part of the shaft of the steam turbine rotor. The radial dimensions of such turbine rotors may be on the order of seven or eight feet excluding turbine blade dimensions. It is well known in the art that such large rotors are subjected to substantial stresses due to their size, and to quality and quantity of steam affecting their turbine blades.

Each turbine wheel includes a hub section generally at its radially inner portion of the wheel and each hub section includes a bore therethrough. The wheel, which is not an integral part of the shaft, is typically secured to the shaft by an interference shrink fit between the radially inner surface of the hub defining the wheel bore and corresponding surface of the shaft. During normal and expected turbine operations, this interference shrink fit prevents rotation of the turbine wheel relative to the shaft and relative to other wheels secured to the shaft.

To ensure proper operation of the turbine, it is required that turbine wheels be maintained at a substantially fixed radial position, relative to the shaft, and at a substantially axially fixed position relative to other wheels on the shaft. These requirements should be met during all turbine operations, including normal but non-steady state conditions, such as overspeed while setting trip limits, and during undesirable abnormal conditions, such as overspeed due to control malfunction or runaway, and during thermal transient periods.

It is recognized in the art that the wheel bore and shaft surface interface is under a substantial degree of stress. This stress, in combination with other stresses such as generated by transient thermal conditions or other unavoidable adverse operating conditions, has been suspected of causing stress corrosion cracking indications in certain regions of the hub of wheels. The precise mechanism which produces stress corrosion cracking is not fully understood, however, it is believed that if stresses at the wheel bore, and along the hub inner surface, are kept at a minimum, and accumulation of water, which may be condensed from steam, is minimized and/or eliminated in that region, the probability of stress corrosion cracking developing in any particular wheel will be reduced if not eliminated.

U.S. Pat. No. 4,029,437, by Aubry et al., discloses a button disposed in a radially intermediate keyway defined between adjacent hubs of adjacent steam turbine wheels. Other disclosures show cylindrical buttons set into keyways to prevent rotation of one wheel with respect to an adjacent wheel in the event the interference shrink fit loosens between the one wheel and the shaft. However, these disclosures do not specifically address local stress in the region proximate the keyway, nor do these disclosures address the shape of the key.

OBJECTS OF THE INVENTION

It is an object of the present invention to provide keying means exposed to ambient environment of a steam turbine rotor.

It is an additional object of the invention to provide a key which is exposed at the periphery of the hub of adjacent turbine wheels thereby allowing exposure to ambient environment of the rotor.

It is a further object of the present invention to provide a keying means which allows a significant amount of steam to flow through and around the keying means to reduce condensation of steam within the keying means region.

It is a further object of the present invention to provide a keyway which minimizes local stress concentration in the corresponding region of the hub.

SUMMARY OF THE INVENTION

In one embodiment of the present invention, a steam turbine rotor includes a rotatable shaft and a plurality of wheels axially spaced along the shaft. Each wheel is affixed to the shaft by an interference shrink fit. Each wheel further carries a plurality of steam turbine blades at its radially outermost portions. Each wheel includes a hub section axially extending from the wheel's radially inner portions. Each hub section has an axial end face surface at each axial end and one of those axial end faces includes a circumferential shoulder defined thereby. Each axial end face includes a radial slot thereon and the radial slot is opened to the periphery of the hub. Radial slots on adjacent wheels are axially aligned to form a substantially radial keyway therebetween. A key is disposed in each keyway. The key includes a body portion and at least a pair of spacing members axially spacing the body portion from the axial end walls of the keyway. Each key further includes at least one flange extending outward from the body portion which mates with the shoulder defined by the axial end face. The leading and trailing faces of the key are in contact with the leading and trailing side walls of the radial slots forming the keyway, respectively. Such contact prevents rotation of one wheel relative to an adjacent wheel in the event of loosening of the interference shrink fit between the one wheel and the shaft.

In another embodiment, the key further includes a radially inner extremity in close proximity to the shaft. In still another embodiment, the hub includes a notch in close proximity to the radial slot on the axial end face and the key includes a tab which mates with the notch.

BRIEF DESCRIPTION OF THE DRAWING

The subject matter which is regarded as the invention is particularly pointed out and distinctly claimed in the concluding portion of the specification. The invention however together with further objects and advantages thereof, may best be understood by reference to the following description taken in conjunction with the accompanying drawing, in which:

FIG. 6*a* is a radial cross sectional partial view of a steam turbine rotor and key from the perspective of section line 6—6' of FIG. 5;

FIG. 6*b* is a radial cross sectional partial view of a steam turbine rotor from the perspective of section line 6"13 6"' of FIG. 5 with the interposed key in the keyway removed;

FIG. 7 illustrates a radially intermediate cutaway view of a key and adjacent portions of the keyway generally from the perspective of section line 7—7' of FIG. 6*a;*

FIG. 12 is a partial, cross sectional axial view of a steam turbine rotor including the most upstream or first steam turbine wheel.

DETAILED DESCRIPTION OF THE DRAWINGS

This invention relates generally to keying means for preventing rotation of one wheel relative to an adjacent wheel in the event of loosening of the shrink fit between the one wheel and the shaft. Similar numerical designations represent like elements throughout.

Figure 1:
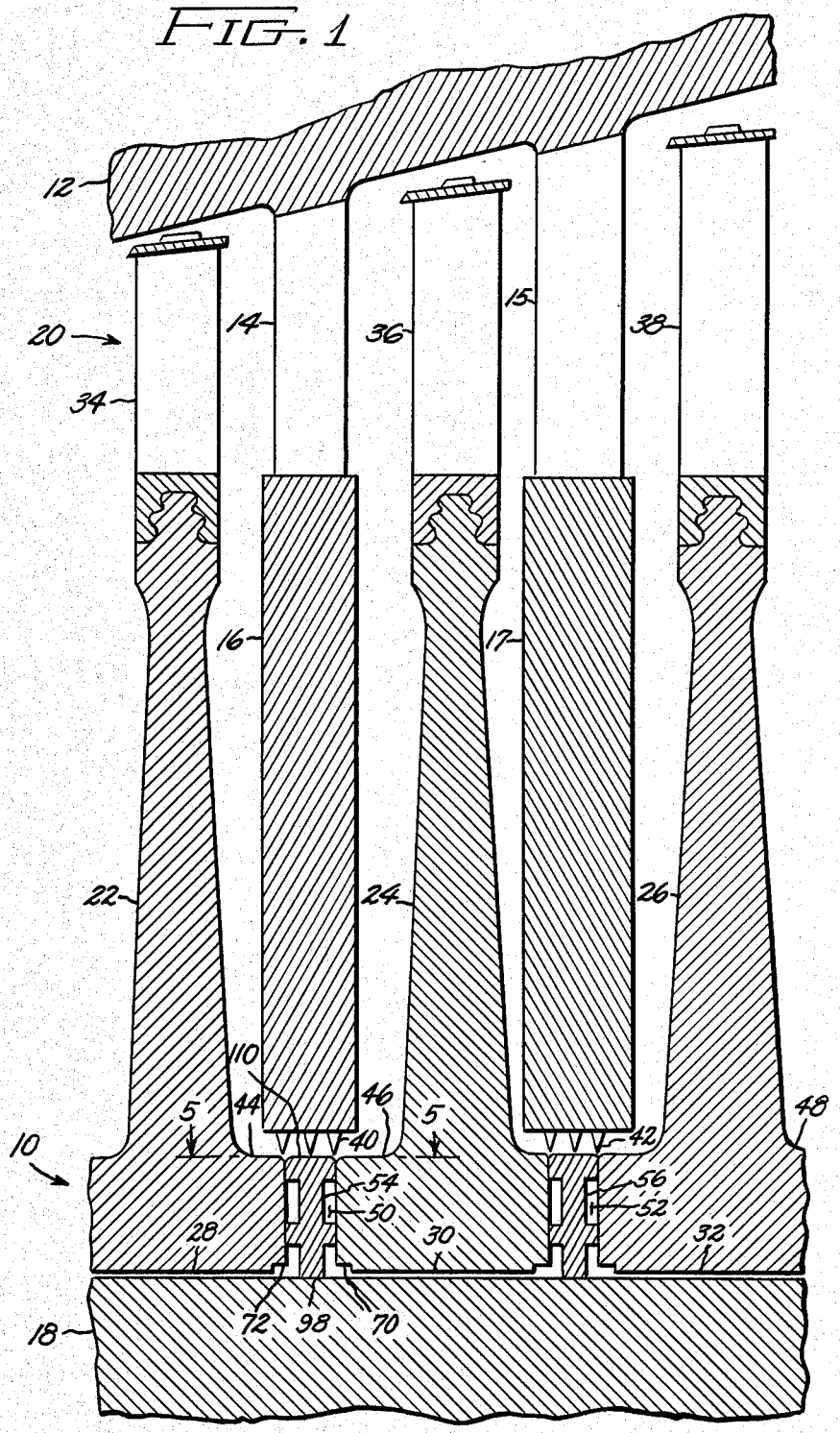
FIG. 1 is a partial, cross sectional, axial view of a steam turbine rotor including three adjacent steam turbine wheels and associated portions of the steam turbine shell, nozzles and diaphragms.

FIG. 1 illustrates a partial, cross sectional view of a steam turbine rotor 10 and associated portions of steam turbine shell 12, nozzles 14 and 15, and diaphragms 16 and 17. As is commonly recognized in the art, a shaft 18 of steam turbine rotor 10 is rotatably mounted. Rotor 10 rotates within turbine shell 12 when steam, in a steam flow path generally designated by reference numeral 20, is channeled and directed by nozzles onto a plurality of steam turbine blades 34, 36 and 38 which are part of rotor 10.

Rotor 10 includes a plurality of steam turbine wheels axially spaced along shaft 18, of which wheels 22, 24 and 26 are illustrated. Each wheel is affixed to shaft 18 by an interference shrink fit between the radially inner surface of the wheel and the shaft. Wheels 22, 24 and 26 include radially inner surfaces 28, 30 and 32, respectively, which are in an interference shrink fit with shaft 18. Each wheel carries a plurality of steam turbine blades at its radially outermost portion. The plurality of blades associated with each wheel are circumferentially aligned. Steam turbine blades 34, 36 and 38 carried by wheels 22, 24 and 26, respectively. Steam turbine blades are commonly affixed to wheels by dovetail fittings. A person of ordinary skill in the art recognizes that steam in steam flow path 20 is directed by nozzles 14 and 15 onto steam turbine blades 36 and 38, respectively. Shell 12 circumferentially surrounds turbine rotor 10 and supports a plurality of nozzles between each set of steam turbine blades. Diaphragms 16 and 17 are rings which are concentric with shaft 18. A person of ordinary skill in the art recognizes that diaphragms maintain radial positioning of nozzles and also provide sealing means between each respective set of turbine blades and turbine wheels and respective adjacent sets of turbine blades and turbine wheels. It is common in steam turbine devices to include labyrinth seals 40 and 42 at the radially innermost portions of diaphragms 16 and 17 respectively. Of course, any suitable sealing means could be utilized at the radially inner portions of the diaphragms to limit axially steam flow at that radially inner region.

Wheels 22, 24 and 26 each include a hub section 44, 46, and 48, respectively. Hubs 44, 46 and 48 are located at the radially inner portion of each wheel and extend axially from both axial ends of the respective wheel. Generally, in accordance with the present invention, hubs define substantially radial keyways between adjacent wheels and corresponding hubs. Hence, keyway 50 is defined between adjacent wheels 22 and 24 by hubs 44 and 46 and keyway 52 is defined between wheels 24 and 26 by hubs 46 and 48. Key 54 is shown disposed in keyway 50 and key 56 is shown disposed in keyway 52.

Figure 2:
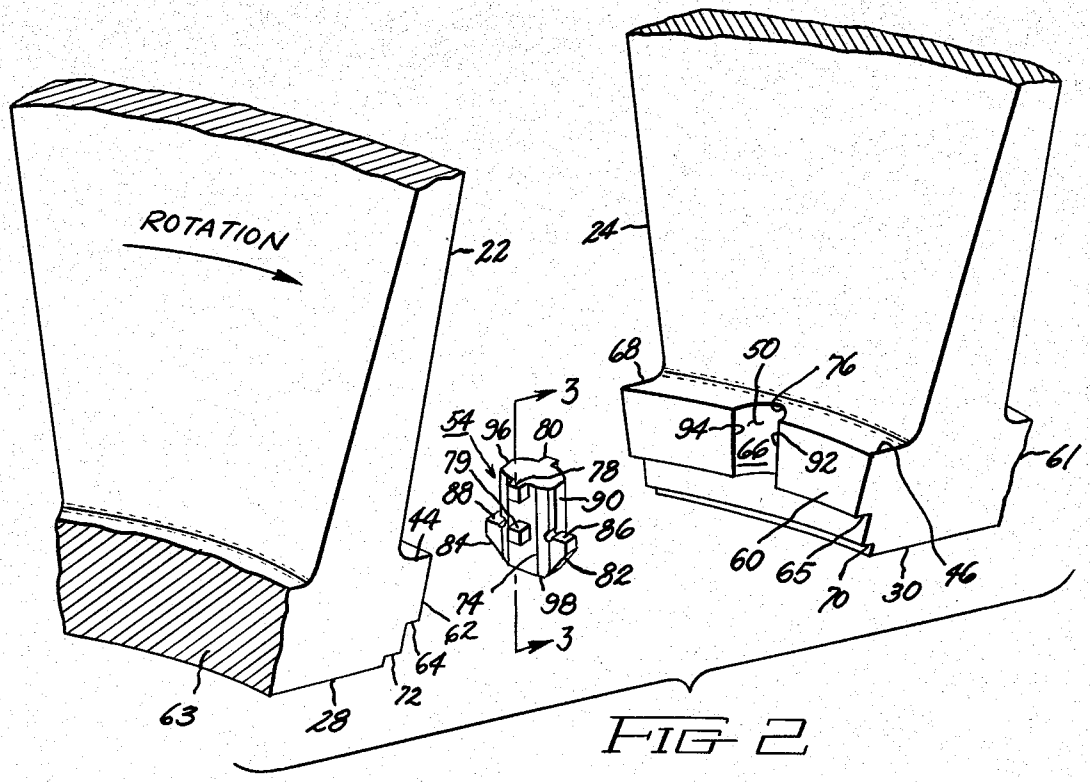
FIG. 2 is an exploded, perspective view of two steam turbine wheels and an interposed key.

Referring to FIG. 2, an exploded, perspective view of key 54, keyway 50, and adjacent wheels 22 and 24 is illustrated. Each hub includes an axial end face surface at each axial end, therefore, hub 46 includes axial end faces 60 and 61 shown (sectioned) and hub 44 includes axial end faces 62 and 63 shown (sectioned). One axial end face opposing an axial end face of an adjacent wheel must include at least one circumferential shoulder. As illustrated in FIG. 2, axial end face 62 includes shoulder 64 and axial end face 60 includes shoulder 65.

Each axial end face also defines at least one substantially radial slot thereon. A radial slot 66 defined by axial end face 60 is open to periphery 68 of hub 46. Radial slot 66 also extends to shaft 18 (FIG. 1) which is proximate surface 30 of wheel 24. A circumferential relief shoulder 70 is cut into each axial end of the radially inner surface 30/shaft 18 (FIG. 1) interface. Likewise, surface 28 interface with surface 62 includes a circumferential relief shoulder 72. It is to be understood that the invention need not include a relief shoulder. Axial end face 62 also includes a substantially radial slot (not shown). Radial slots on respective opposing axial end faces 60 and 62 of adjacent wheels 24 and 22, respectively, are axially aligned to form a substantially radial keyway 50 therebetween. As used herein, the terms "radial" and "axial" refer to those aspects of shaft 18 (FIG. 1). Also, the term "axially aligned radial slots" is meant to mean radial slots which are aligned by rotating one wheel with respect to an adjacent wheel such that the slots register to form a axial keyway therebetween.

Key 54 is disposed in keyway 50. Keyway 50 includes radial slot 66 and a corresponding radial slot (not shown) on axial end face 62 open to periphery 67 of hub 44, both radial slots being axially aligned. Key 54 comprises a body portion 74 and at least a pair of spacing means 78 and 80, such as spacing members, which may be integral therewith and which axially space body portion 74 from axial end wall 76 of keyway 50. In the illustrated embodiment of FIG. 2, key 54 includes spacing members 78 and 79 extending from one axial face of body 74 and another pair of corresponding spacing members extending from the opposite axial face of body 74, one of which is illustrated as member 80. Hence, member 80 and the other radially distance spacing member 81 (shown in FIG. 4) axially space key 54 apart from axial end wall 76 of radial slot 66, and hence, keyway 50. Spacing members 78 and 79 axially space key 54 from the corresponding axial end wall (not shown) of keyway 50 in axial end face 62. A person of ordinary skill in the art would recognize that key 54 could include a pair of radially extending spacing ribs, one rib disposed on or integral with each respective axial face of key 54. Similarly, a person of ordinary skill in the art would recognize that only one spacing member need be disposed on or integral with each axial face of key 54 in order to space key 54 from respective axial end walls of keyway 50. In this manner, key 54 as illustrated in FIG. 2 only shows one possible geometric configuration.

Key 54 includes at least one flange 82 and 84 extending outward from its body portion such that at least one flange mates with retaining means 64 or 65, such a shoulder, fixedly secured to hub 44 or 46, respectively, when key 54 is operably disposed within keyway 50. Alternately, at least one of flange 82 and 84 may mate with shoulder 65 or with both shoulder 64 and shoulder 65. Key 54 includes flange 82 extending in one tangential direction and flange 84 extending in the opposite tangential direction from body 74. Flanges 82 and 84 mate with shoulder 64 defined by axial end face 62 and relief shoulder 72. Specifically, flanges 82 and 84 include radially outer surfaces 86 and 88, respectively, which mate with the radially inner surface of shoulder 64. Flanges 82 and 84 prevent key 54 from moving radially outward from keyway 50 due to centrifugal or other forces developed by rotation of rotor 10 (FIG. 1). A person of ordinary skill in the art would recognize that only one flange need extend from body 74 of key 54 to prevent radially outward movement of key 54 in keyway 50. Also, a person of ordinary skill in the art would recognize that such a flange could extend in any of a plurality of tangential directions away from body 74, however, retaining means 64 and/or 65 such as a shoulder or stop, which would be fixedly secured to one of the adjacent hubs forming keyway 50, would necessarily engage such a flange, to prevent radially outward movement of key 54. In this sense, the flange need only extend outward from body portion 74 of key 54 in order to engage retaining means 64 and/or 65 to prevent radially outward movement of key 54.

To prevent rotation of one wheel relative to an adjacent wheel, such as in the event of loosening of the interference shrink fit between the one wheel and shaft 18 (FIG. 1), key 54 must engage and interact with portions of keyway 50. Specifically, key 54 includes a leading face 90 which contacts a leading sidewall 92 of slot 66. As used herein, the terms "leading" and "trailing" refer to the portions of the structure as they relate to the direction of rotation of shaft 18 (FIG. 1) and shown in FIG. 2. Slot 66 includes a trailing sidewall 94 and key 54 includes a trailing face 96. Trailing face 96 contacts trailing sidewall 94. It is to be understood that although key 54 includes leading face 90 and trailing face 96, flanges 82 and 84 may also include leading and trailing faces. However, an important aspect of this invention is that leading and trailing faces 90 and 96, respectively, of key 54 are surfaces of body 74 and which prevent rotation of wheel 22 relative to wheel 24 in the event of loosening of the interference shrink fit between surface 28 or 30 and shaft 18 (FIG. 1). Key 54 also includes a radially inner extremity 98 which is in close proximity to shaft 18 (FIG. 1) to limit inward radial motion when the shaft is not rotating. Extremity 98 may be an integral part of body 74 of key 54. However, a person of ordinary skill in the art would recognize that extremity 98 could have a relatively small axial dimension as compared with the axial dimension of body 74 and extend radially between body 74 and shaft 18 (FIG. 1).

Figure 3:
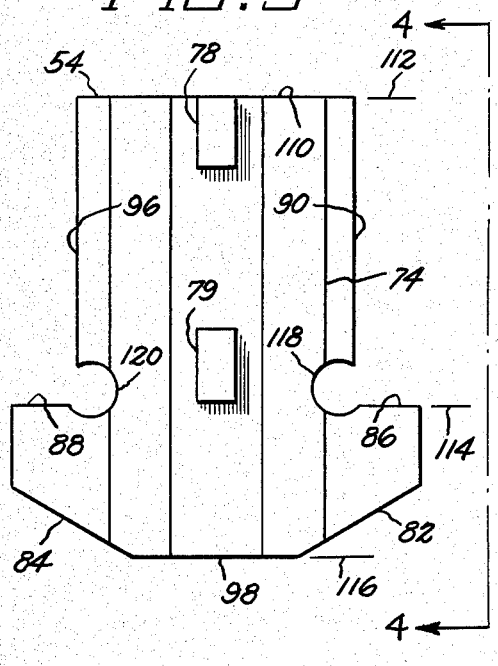
FIG. 3 illustrates a view looking in the direction of the arrows of line 3—3 of FIG. 2.

FIG. 3 illustrates a view, looking in the direction of the arrows of line 3—3 of FIG. 2, of key 54 shown in FIGS. 1 and 2. Key 54 includes a radially outer surface 110, which in this particular illustrated embodiment is substantially coplanar with periphery 68 (FIG. 2) of hub 46 (FIG. 2), when key 54 is operationally disposed in keyway 50 (FIG. 2). Plane 112 generally designates the outer radial surface or periphery 68 of hub 46. It is to be understood that key 54 need not radially extend to plane 112 but could be inwardly radially foreshortened therefrom. However, it is important that surface 110 of key 54 be exposed to the ambient environment of rotor 10. This exposure of surface 110 is clearly illustrated in FIG. 1. This exposure, in combination with the axial spacing of body 74 of key 54 from the axial end walls of keyway 50 (FIG. 2), allows steam to enter the upstream or wheel 22 (FIG. 1) side of keyway 50 (FIG. 1), pass through keyway 50 (FIG. 1), and exit the downstream or wheel 24 (FIG. 1) side of keyway 50 (FIG. 1). As used herein, the terms "upstream" and "downstream" refer to portions of structures in relation to steam flow along steam flow path 20 illustrated in FIG. 1. A person of ordinary skill in the art would recognize that a pressure differential exists axially between upstream side of diaphragm 16 (FIG. 1) and downstream side of diaphragm 16 (FIG. 1). This pressure differential assists steam to flow through keyway 50 (FIG. 1). It is believed that a flow of steam through keyway 50 reduces the temperature gradient across keyway 50 and thus assists reducing the amount of water which may be condensed from steam which enters keyway 50. It is further believed that the concentration of oxygen in condensed water and/or further saturation of steam increases the probability of stress corrosion cracking occurring in the region of keyway 50. In this regard, it is important that surface 110 of key 54 be exposed to the ambient environment of rotor 10 and further that key 54 be axially spaced from either axial end wall of keyway 50 (FIG. 1). Flange surfaces 86 and 88 of flange 82 and 84, respectively, are substantially coplanar as shown by reference plane 114. Plane 114 is radially intermediate periphery 68 (FIG. 2) of hub 46 (Fig. 2), i.e., plane 112, and the surface of shaft 18 (FIG. 1). Reference plane 116 is substantially coplanar with the surface of shaft 18 (FIG. 1) when key 54 is operationally situated within keyway 50 (FIG. 2). It is to be recognized that surfaces 86 and 88 could be at any radially intermediate location between plane 112 and plane 116 as long as corresponding appropriate configuration of retaining means 64 (FIG. 2), as hereinbefore described is provided. Body 74 of key 54 includes circular relief grooves 118 and 120 respectively separating leading face 90 from flange 82 and trailing face 96 from flange 84. It is believed relief grooves 118 and 120 reduce the possibility of stress corrosion cracking occurring in key 54.

Figure 4:
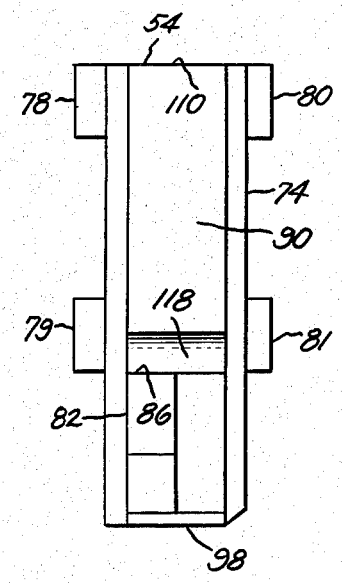
FIG. 4 illustrates a view looking in the direction of the arrows of line 4—4 of FIG. 3.

Referring to FIG. 4 a view of key 54, looking in the direction of arrows of line 4—4 of FIG. 3, is shown. The other spacing member 81 associated with spacing member 80 and discussed earlier with respect to FIG. 2 is shown. Each of spacing members 78, 79, 80 and 81 axially extend from body 74 of key 54 and may be integral therewith. Each spacing member includes an axially outboard surface which contacts respective axial end walls of keyway 50 (FIG. 2). A person of ordinary skill in the art would recognize that extremity 98 could have its axial dimension reduced to approximately equal the axial dimension of flange 82, thereby significantly reducing the mass of key 54.

Figure 5:
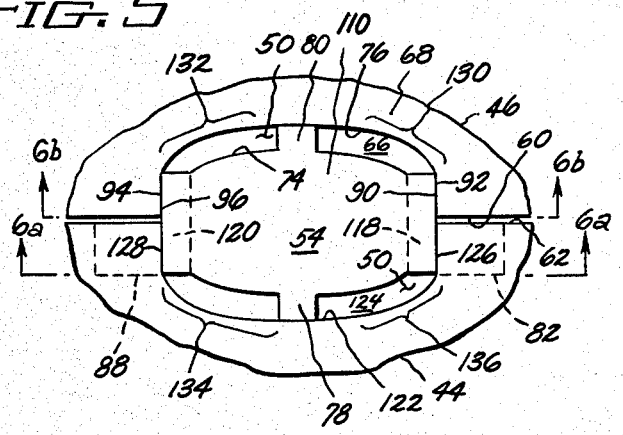
FIG. 5 illustrates a radially inward view of a radial key and adjacent portions of adjacent wheels which define a keyway.

FIG. 5 illustrates a partial, radially inward view of key 54 and surrounding region of adjacent hubs 44 and 46 looking in the direction of arrows of line 5—5 of FIG. 1. Members 78 and 80 of key 54 respectively axially space body 74 of key 54 from axial end wall 76 of slot 66 and from the axial end wall 122 of radial slot 124 (discussed in regard to FIG. 2) on axial end face 62. Spacing is necessary for practice of the invention. Radial slot 66 and 124 are axially aligned to form radial keyway 50 therebetween as hereinbefore described.

Slot 124 includes a leading sidewall 126 and a trailing sidewall 128. Leading face 90 of key 54 respectively contacts leading sidewall 92 and leading sidewall 126 of slots 66 and 124, respectively. Similarly, trailing face 96 respectively contacts trailing sidewall 94 and trailing sidewall 128 of slots 66 and 124, respectively. Contact between leading and trailing faces and respective sidewalls effectively prevents rotation of wheel 22 (FIG. 1) relative to adjacent wheel 24 (FIG. 1). To further reduce the possibility of stress corrosion cracking occurring, adjoining region 130 of slot 66 extends between leading sidewall 92 and axial end wall 76 of slot 66 and includes a streamlined fillet over its axially directed surface. As used herein, the term "streamlined fillet" includes a continually changing radius of curvature over its surface as contrasted to a simple curve which typically has a single radius of curvature. Studies have shown that a streamlined fillet in adjoining region 130 significantly reduces local stress in the region of radial slot 66. Adjoining region 132 extends between trailing sidewall 94 and axial end wall 76 of slot 66. Similar adjoining regions 134 and 136 extend between trailing face 128 and axial end wall 122, and leading face 126 and axial end wall 122, respectively, of slot 124. Adjoining regions 132, 134 and 136 include streamlined fillets over the respective axially directed surfaces to reduce local stress on hubs 46 and 44, respectively, in the region of keyway 50, as hereinbefore described with respect to adjoining region 130.

FIG. 6*a* is a cross sectional, semi-circular, radial view of steam turbine rotor 10 as viewed from the perspective of section line 6—6' of FIG. 5. Some items (which have been explicitly shown in other Figures) have not been shown to improve clarify and to avoid unduly cluttering FIG. 6*a*. FIG. 6*a* clearly illustrates key 54 including flanges 82 and 84 having surfaces 86 and 88, respectively, contacting shoulder 64. FIG. 6*a* also illustrates the radial extent of key 54. Inward radial extremity 98 of key 54 is in close proximity to shaft 18 to limit radial movement of key 54 when shaft 18 is not rotating.

FIG. 6*b* is a partial, semi-circular, cross sectional radial view as viewed from the perspective of section line 6''—6''' of FIG. 5 with key 54 removed. FIG. 6*b* clearly illustrates the radial extent of slot 66 from the periphery of hub 46 extending to shaft 18. FIG. 6*b* also shows that axial end face 60 is substantially radially aligned.

A person of ordinary skill in the art would recognize that axial end face 60 need not include a shoulder 65 analogous to shoulder 64 (FIG. 2) in which case slot 66 would extend from the periphery of hub 46 to shaft 18. Flanges 82 and 84 (FIG. 2) would extend tangentially outward from body 74 of key 54 (FIG. 2) and mate with shoulder 64 on adjacent opposing axial end face 62 (FIG. 2) to limit radial movement of key 54 in keyway 50 (FIG. 2).

FIG. 7 is a partial, radially inward, cutaway view as viewed from the perspective of section line 7—7' of FIG. 6*a*. FIG. 7 clearly illustrates that the axially outboard surface of spacing member 81 of key 54 spaces body 74 of key 54 axially away from axial end wall 76 of slot 66.

Figure 8:
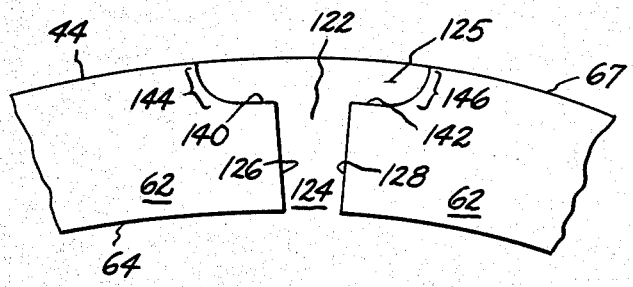
FIG. 8 is a partial, perspective view of an adjacent shoulder and a radial slot which forms a keyway.

FIG. 8 is a partial axial view of another configuration of slot 124 on axial end face surface 62 of hub 44. The outer radial portion of hub 44 in the area of slot 124 terminates in a relieved region 125. Region 125 is defined by flat surfaces 140 and 142 respectively extending from leading and trailing sidewalls 126 and 128, respectively, of slot 124, and inward radially directed filleted surfaces 144 and 146 respectively extending from flat surfaces 140 and 142, respectively to the periphery 67 of hub 44. Region 125 may extend axially into hub 44 to be coextensive with end surface 122 of slot 124.

When the configuration as illustrated in FIG. 8 is used, a key (not shown) to be inserted into slot 124 and corresponding slot 66 (FIG. 2) comprises circumferentially extending members (not shown) which contact fillets 144 and 146 and surfaces 140 and 142. The circumferentially extending members configured to fill region 125 in order to minimize steam leakage into the keyway 50 (FIG. 1). Contact of the circumferentially extending members with surfaces 140 and 142 prevents radially inward movement of the key toward shaft 18 (FIG. 1) while contact of surfaces 86 and 88 of flanges 82 and 84 (FIG. 2) with shoulder 64 prevents radially outward movement of the key away from shaft 18 (FIG. 1).

Figure 9:
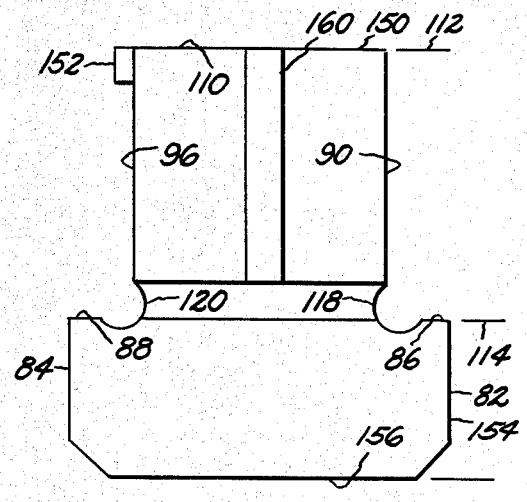
FIG. 9 illustrates a radial view of an alternate embodiment of a key.

FIG. 9 illustrates an alternative embodiment of key 54 (FIG. 3) designated as key 150. To limit radial movement of key 150 in substantially radial keyway 50 (FIG. 2), a tab 152 extends from the periphery of key 150 proximate outer radial surface 110. In this sense, key 150 has a radially inner extremity surface 156 which may be radially spaced from the surface of shaft 18 (FIG. 1) when operatively situated in keyway 50 (FIG. 2). Reference plane 114 is radially intermediate reference plane 158 and plane 112. An axial spacing member 160, illustrated as a rib, extends axially from and along the radial length of body 74 of key 150.

Figure 10:
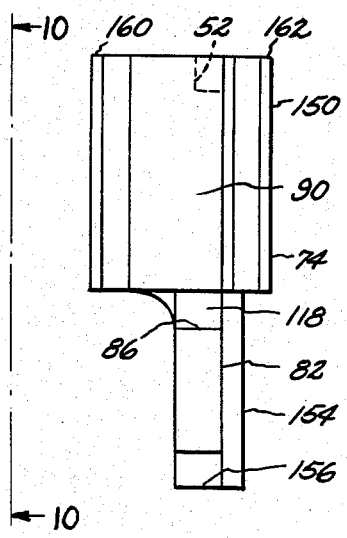
FIG. 10 illustrates a radial view of the key illustrated in FIG. 9.

FIG. 10 is a radial view of key 150 looking in the direction of the arrows of line 10—10 of FIG. 9. The axial dimension of extremity 154 is smaller than the axial dimension of body 74 of key 150. Also, an axial spacing member 162 extends from body 74 in the opposite axial direction from spacing member 160.

Figure 11:
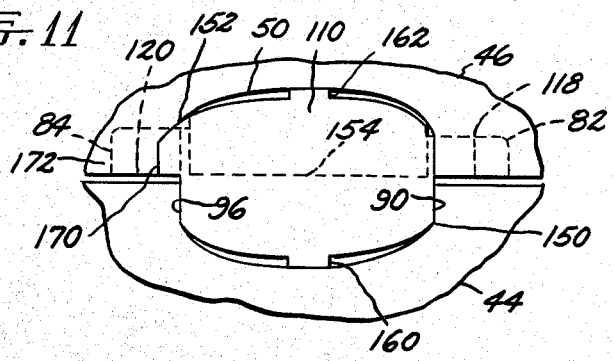
FIG. 11 illustrates a partial, radially inward view of the key illustrated in FIG. 9 disposed in a keyway defined by two adjacent wheels.

FIG. 11 is a partial, cutaway, radially inward view of key 150 disposed in keyway 50 between adjacent hubs 44 and 46. A notch 170, sized to permit entry of tab 152 of key 150 therein, is recessed into peripheral surface 172 of hub 46. Tab 152 cooperates with notch 170 to prevent key 150 from moving radially inward towards shaft 18 (FIG. 1). As stated earlier, flanges 82 and 84 prevent key 150 from moving radially outward in keyway 50. Spacing members 160 and 162 axially space key 150 from respective axial end walls of keyway 50.

Referring to FIG. 12, a partial cross-sectional axial view of a steam turbine rotor 10 including most upstream or first steam turbine wheel 22 is shown. A flange 200 radially extending from shaft 18 and may be integral therewith. Alternatively, flange 200 may comprise a ring or collar secured to shaft 18 such that relative motion, both axially and rotationally, between the ring and shaft 18 is prevented. A substantially radial keyway 202 (analogous to keyway 50 (FIG. 2) between hub 44 and 46 (FIG. 2)) for reception of key 54, is established between hub 204 and flange 200 by providing in axial registration a radial slot (not shown) (analogous to radial slots 66 and 124 in hubs 46 and 44, respectively) in each of opposing adjacent surfaces 208 and 206 of flange 200 and hub 204, respectively.

When key 54 is operatively disposed in keyway 202, relative motion between wheel 22 and shaft 18 is prevented as hereinbefore described. Of course, surface 208 of flange 200 may include a shoulder (not shown), analogous to shoulder 64 (FIG. 2), in order to provide mating surfaces for flanges 82 and 84 (FIG. 2) of key 54.

Flange 200 extends radially from the circumference of shaft 18 a distance sufficient to permit adequate provision for the radial slot and a shoulder in surface 208 of flange 200, in order to prohibit key 54, when operatively disposed in keyway 202, from moving radially with respect to shaft 18, as hereinbefore described. All modifications and alternative embodiments described herein apply to the keyway between hub 204 and flange 200 and to the key to be disposed thereinbetween.

Thus has been illustrated and described keying means exposed to ambient environment of a steam turbine rotor. Further, a key exposed at the periphery of the hub of adjacent turbine wheels, allowing exposure to ambient environment of the rotor has been shown and described. Additionally, keying means which allows a significant amount of steam to flow through and around the keying means to reduce condensation of steam within the region of keying means and a keyway which minimizes local stress concentration in the corresponding region of the hub have been illustrated and described.

A person of ordinary skill in the art would recognize that only one pair of adjacent wheels need utilize the exposed radial key disposed in a radial keyway as disclosed herein. Also, a person of ordinary skill in the art would recognize that adjacent turbine wheels may include a respective plurality of radial keyways between each wheel and a plurality of keys disposed therein. In such a device, the plurality of interposed keys would prevent rotation of one wheel relative to the adjacent wheel in the event the interference shrink fit between the one wheel and the shaft loosens. A person of ordinary skill in the art could recognize alternate geometric configurations for the key. However, the key must include spacing means, such as a pair of respectively oppositively axially extending spacing members, to space the key away from each axial end wall of the keyway, and retaining means, such as a flange, to limit outward radial movement of the key in the keyway.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. In a steam turbine, a rotor comprising:

a rotatable shaft;

a plurality of wheels axially spaced along said shaft and respectively affixed thereto by an interference shrink fit between the respective radially inner surface of said wheels and said shaft, each wheel of said plurality of wheels carrying a plurality of circumferentially aligned steam turbine blades at the radially outermost portion of said each wheel, at least two adjacent wheels, each of said at least two adjacent wheels respectively comprising:

a hub section at the radially inner portion of the wheel, said hub extending axially from both axial ends of the wheel, said hub including an axial end face surface at each axial end of the hub;

each opposing axial end face respectively defining at least one substantially radial slot thereon, each said radial slot being open to the periphery of the respective hub and extending to said shaft, each said radial slot being axially aligned with the respective radial slot on the respective opposing end face to form a substantially radial keyway between the hubs of said at least two adjacent wheels;

retaining means fixedly secured to the hub section of one of the opposing axial end faces for preventing outward radial movement of any key to be disposed in the keyway; and at least one key disposed in said keyway, said key comprising a body portion and at least a pair of spacing means for axially spacing said key from respective axial end walls of said keyway, said key including at least one flange extending outwardly from said body portion and engaging said retaining means said key further including a radially inner extremity in close proximity to said shaft, and a leading and a trailing face, said leading and trailing face respectively contacting a leading and a trailing sidewall of said keyway, respectively.

2. A rotor as in claim 1 wherein said retaining means comprises at least one circumferential shoulder defined by one axial end face in said one of said at least two adjacent wheels, said one axial end face opposing the axial end face of said another of said at least two adjacent wheels.

3. In a steam turbine, a rotor comprising:

a rotatable shaft;

a plurality of wheels axially spaced along said shaft and respectively affixed thereto by an interference shrink fit between the respective radially inner surface of said wheels and said shaft, each wheel of said plurality of wheels carrying a plurality of circumferentially aligned steam turbine blades at the radially outermost portion of said each wheel, each wheel respectively comprising:

a hub section at the radially inner portion of the wheel, said hub extending axially from both axial ends of the wheel, said hub including an axial end face surface at each axial end of the hub such that adjacent wheels include respective opposing axial end face surfaces;

each opposing axial end face defining at least one substantially radial slot respectively thereon, the radial slot being open to the periphery of the respective hub and extending to said shaft, each said radial slot being axially aligned with the respective radial slot on the respective opposing end face to form a respective plurality of substantially radial keyways between the respective hubs of each adjacent wheel of said plurality of wheels;

retaining means fixedly secured to the hub section of one of the respective opposing axial end faces of each respective pair of opposing axial end faces for preventing outward radial movement of any key to be disposed in the respective keyway; and a plurality of keys respectively disposed in each respective one of the plurality of keyways, each of said plurality of keys respectively comprising a body portion and at least a pair of spacing means for axially spacing the respective key from the respective axial end walls of the respective keyway, each of said plurality of keys respectively including at least one flange extending outwardly from said body portion and engaging said respective retaining means, each of said plurality of keys respectively further including a radially inner extremity in close proximity to said shaft, and a leading and a trailing face, said leading and trailing face respectively contacting a leading and a trailing sidewall of the respective keyway.

4. A rotor as in claim 3 wherein said retaining means respectively comprises at least one circumferential shoulder defined by one axial end face of the respective opposing axial end faces of each respective pair of opposing axial end faces.

5. A rotor as in claims 1 or 3 wherein the respective spacing means comprises two pairs of integral spacing members, each respective one of said pair of spacing members oppositely axially extending from the respective other one of said respective pair and each respective spacing member being radially displaced along the respective body portion of the respective key.

6. A rotor as in claims 1 or 3 wherein each said key respectively further comprises a pair of flanges, each respective one of said flanges extending in a respective opposite direction from the respective body portion of the respective key, both of said respective pair of flanges being respectively radially aligned with respect to said shaft, and each respective said flange including a respective radially outer surface engaging said respective retaining means.

7. A rotor as in claims 2 or 4 wherein each said respective key further comprises a pair of flanges, each respective one of said respective pair of flanges extending in a respective opposite direction from the respective body portion of the respective key, both of said respective pair of flanges being respectively radially aligned with respect to said shaft, and each respective said flange including a respective radially outer surface respectively contacting the respective radially inner portion of the respective shoulder.

8. A rotor as in claims 1 or 3 wherein the respective adjoining region between each respective said leading sidewall of said respective radial slot and the respective corresponding axial end wall of said radial slot respectively comprise a streamlined fillet, and the respective adjoining region between each respective said trailing sidewall of said respective radial slot and the respective corresponding axial end wall of said respective radial slot respectively comprise a streamlined fillet.

9. In a steam turbine, a rotor comprising:

a rotatable shaft;

a plurality of wheels axially spaced along said shaft and respectively affixed thereto by an interference shrink fit between the respective radially inner surface of said wheels and said shaft, each wheel of said plurality of wheels carrying a plurality of circumferentially aligned steam turbine blades at the radially outermost portion of said each wheel, at least two adjacent wheels, each of said at least two adjacent wheels respectively comprising:

a hub section at the radially inner portion of the wheel, said hub extending axially from both axial ends of the wheel, said hub including an axial end face surface at each axial end of the hub such that said at least two adjacent wheels include respective opposing axial end face surfaces;

each opposing axial end face surface respectively defining at least one substantially radial slot thereon, each said radial slot being open to the periphery of the respective hub and radially extending from the periphery of the respective hub at least partially along the radial extent of the respective hub towards said shaft, each said radial slot being axially aligned with the respective radial slot on the respective opposing end face to form a substantially radial keyway between the hubs of said at least two adjacent wheels;

retaining means fixedly secured to the hub section of one of the opposing axial end faces for preventing outward radial movement of any key to be disposed in the keyway;

the respective hub having at least one notch terminating at the respective slot of the respective hub;

at least one key disposed in said keyway between the hubs of said at least two adjacent wheels, said key comprising a body portion and at least a pair of spacing means for axially spacing said key from respective axial end walls of said keyway, said key including at least one flange extending outwardly from said body portion and engaging said retaining means, said key further including tab means for preventing inward radial movement of the keys said tab means mateable with said notch, and a leading and a trailing face, said leading and trailing face respectively contacting a leading and a trailing sidewall of said keyway, respectively.

10. A rotor as in claim 9 wherein said retaining means comprises at least one circumferential shoulder defined by one axial end face in said one of said at least two adjacent wheels, said one axial end face opposing the axial end face of said another of said at least two adjacent wheels.

11. A rotor as in claim 9 wherein said notch further terminates on the periphery of the respective hub and said tab means is disposed at a radially outer portion of said key.

12. In a steam turbine, a rotor comprising:

a rotatable shaft;

a plurality of wheels axially spaced along said shaft and respectively affixed thereto by an interference shrink fit between the respective radially inner surface of said wheels and said shaft, each wheel of said plurality of wheels carrying a plurality of circumferentially aligned steam turbine blades at the radially outermost portion of said each wheel, each wheel respectively comprising:

a hub section at the radially inner portion of the wheel, said hub extending axially from both axial ends of the wheel, said hub including an axial end face surface at each axial end of the hub such that adjacent wheels include respective opposing axial end face surfaces;

each opposing axial end face defining at least one substantially radial slot respectively thereon, the radial slot being open to the periphery of the respective hub and radially extending from the periphery of the respective hub at least partially along the radial extent of the respective hub towards said shaft, each said radial slot being axially aligned with the respective radial slot on the respective opposing end face to form a respective plurality of substantially radial keyways including at least one keyway between each respective pair of opposing axial end face surfaces;

retaining means fixedly secured to the hub section of one of the respective opposing axial end faces of each respective pair of opposing axial end faces for preventing outward radial movement of any key to be disposed in the respective keyway;

the respective hub having at least one notch terminating at the respective slot of the respective hub;

a plurality of keys respectively disposed in each said plurality of keyways, each said key comprising a body portion and at least a pair of spacing means for axially spacing said key from respective axial end walls of the respective keyway, each said key including at least one flange extending outwardly from the respective body portion and engaging said retaining means, each said key further including tab means for preventing inward radial movement of the respective key, said tab means mateable with said respective at least one notch, and a leading and a trailing face, said leading and trailing face respectively contacting a leading and a trailing sidewall respectively of said respective keyway.

13. A rotor as in claim 12 wherein said retaining means respectively comprises at least one circumferential shoulder defined by one axial end face of the respective opposing axial end faces of each respective pair of opposing axial end faces.

14. A rotor as in claim 12 wherein said respective notch further terminates on the periphery of the respective hub and the respective tab means is disposed at a respective radially outer portion of the respective key.

15. A rotor as in claims 9 or 12 wherein the respective spacing means comprises two pairs of integral spacing members, each respective one of said pair of spacing members oppositely axially extending from the respective other one of said respective paid and each respective spacing member being radially displaced along the respective body portion of the respective key.

16. A rotor as in claims 9 or 12 wherein each said key respectively further comprises a pair of flanges, each respective one of said respective pair of flanges extending in respective opposite direction from the respective body portion of the respective key, both of said respective pair of flanges being respectively radially aligned with respect to said shaft, and each respective said flange including a respective radially outer surface engaging said respective retaining means.

17. A rotor as in claims 9 or 12 wherein the respective adjoining region between each respective said leading sidewall of said respective radial slot and the respective corresponding axial end wall of said radial slot respectively comprise a streamlined fillet, and the respective adjoining region between each respective said trailing sidewall of said respective radial slot and the respective corresponding axial end wall of said respective radial slot respectively comprise a streamlined fillet.

18. A rotor as in claims 10 or 13 wherein each said respective key further comprises a pair of flanges, each respective one of said respective pair of flanges extending in a respective opposite direction from the respective body portion of the respective key, both of said respective pair of flanges being respectively radially aligned with respect to said shaft, and each respective said flange including a respective radially outer surface respectively contacting the respective radially inner portion of the respective shoulder.

* * * * *